US005983501A

United States Patent [19]

Izumi

[11] Patent Number: 5,983,501

[45] Date of Patent: Nov. 16, 1999

[54] ELECTRIC SHAVER

[75] Inventor: Yukio Izumi, Matsumoto, Japan

[73] Assignee: Izumi Products Company, Nagano, Japan

[21] Appl. No.: 09/044,456

[22] Filed: Mar. 19, 1998

[30] Foreign Application Priority Data

Apr. 2, 1997 [JP] Japan ..... 9-083869

[51] Int. Cl.[6] ..... B26B 19/14

[52] U.S. Cl. ..... 30/43.5; 30/43.4

[58] Field of Search ..... 30/43, 43.4, 43.5, 30/43.6, 346.51

[56] References Cited

U.S. PATENT DOCUMENTS

| | | | |
|---|---|---|---|
| 2,283,834 | 5/1942 | Van Dam et al. | 30/43.5 |
| 2,308,920 | 1/1943 | Horowitz et al. | 30/43.5 |
| 2,396,181 | 3/1946 | Kerwer | 30/43.5 |
| 3,264,734 | 8/1966 | Starre | 30/43.5 |
| 3,298,101 | 1/1967 | MacCarthy | 30/43.5 |
| 4,001,932 | 1/1977 | Herrick | 30/43.5 |
| 4,038,747 | 8/1977 | Upton | 30/43.5 |
| 4,301,593 | 11/1981 | May . | |

FOREIGN PATENT DOCUMENTS

| | | |
|---|---|---|
| 0721826 | 7/1996 | European Pat. Off. . |
| 1192334 | 10/1959 | France . |

*Primary Examiner*—Hwei-Siu Payer
*Attorney, Agent, or Firm*—Koda & Androlia

[57] ABSTRACT

An electric shaver including a single electric motor and a plurality of, for instance three, inner and outer cutters. The output shaft of the motor meshes with gear chains coupled to the inner cutters so that the inner cutters are rotated by the motor; and the output shaft of the motor is further coupled to a speed reduction mechanism that has a gear meshing with gears provided on the peripheries of the outer cutters so that the outer cutters are rotated by the motors at a slower rotation than the inner cutters.

4 Claims, 5 Drawing Sheets

ELECTRIC SHAVER

BACKGROUND OF THE INVENTION

1. Field of the Invention

The present invention relates to an electric shaver and more particularly to a rotary type electric shaver.

2. Prior Art

Electric shavers, especially rotary type electric shavers, generally include outer cutters and inner cutters; and the inner cutters are rotated on the undersurfaces of the outer cutters and cut hairs such as hairs on the head, whiskers, etc. (merely called "hairs"), which are introduced through the slits (hair entry openings) formed in the outer cutters, by a shearing force that is generated by the rotating inner cutters and the stationary outer cutters.

In today's commercially marketed electric shavers, as seen from the above, only the inner cutters, which are provided inside the head part of the shaver body, are rotated by an electric motor installed inside the shaver housing; and the outer cutters, which are also provided in the shaver head, are not rotated.

When these shavers are used, it is necessary that the hairs be introduced into the hair entry slits formed in the outer cutters; accordingly, the person using the shaver needs to constantly move the shaver head over the surface of the skin while holding the shaver housing with one hand.

However, such constant movement of the shaver during shaving while holding it with one hand over a period of several minutes to ten or so minutes causes fatigue of the arm muscles and, therefore, pain.

In view of these problems, an electric shaver that includes rotary outer cutters for smoothly bringing hairs into the hair entry slits has been proposed as disclosed in Japanese Patent Application Pre-Examination Publication (Kokai) No. H7-16360.

However, this electric shaver uses a plurality of electric motors as driving sources for rotating the outer cutter and inner cutter. Accordingly, it is difficult to construct a compact electric shaver.

Furthermore, since the outer cutter is, like the inner cutter, attached directly to the output shaft of an electric motor, the rotational speed is generally high, and this causes the skin to be abraded and injured. Furthermore, the outer cutters of electric shavers make direct contact with the skin and are therefore subjected to resistance by the skin. Thus, in order to directly drive such outer cutters, a high-torque electric motor is required However, such high-torque electric motors are generally large in size and thus conflict with the required compactness of the electric shaver. Also, such high-torque electric motors are more expensive.

SUMMARY OF THE INVENTION

Accordingly, it is a general object of the present invention to solve the problems with the prior art electric shavers.

The primary object of the present invention is to provide an electric shaver which includes rotatable outer and inner cutters, with the rotational speed of the outer cutters being reduced and the overall size being compact.

The above object is accomplished by a unique structure for a rotary shaver of the present invention which includes a single electric motor, outer cutter(s) rotated by the electric motor, and inner cutter(s) installed in combination with the outer cutter(s) and rotated by the electric motor, and the shaver is further provided with a speed reduction mechanism constructed from a planetary gear assembly that is installed between a motor shaft gear attached to the output shaft of the electric motor and gears attached to the outer cutter(s).

In the structure described above, the speed reduction mechanism in the form of a planetary gear assembly is employed as a mechanism that reduces the rotational speed of the outer cutters; accordingly, the electric shaver can be made more compact compared to shavers that use combinations of spur gears as a speed reduction mechanism.

Furthermore, the speed reduction mechanism comprises a plurality of planetary gear assemblies, and each consists of an internal sun gear, a plurality of planet gears which are rotatably installed on a carrier and engage with the internal sun gear, and an external sun gear which is disposed in the center of the plurality of planet gears and engages with the planet gears; and these planetary gear assemblies are arranged so as to be one on the other, or stacked, in multiple stages. In addition, the internal sun gears of each planetary gear assemblies are formed on an inner surface of a single cylindrical body so as to be commonly used with the external sun gears. Furthermore, one of the planetary gear assemblies is meshed with the external sun gear of the other adjacent planetary gear assembly at the center of rotation of the carrier of the planetary gear assemblies. In other words, in this speed reduction mechanism, a plurality of planetary gear assembles are arranged in multiple stages so as to obtain a large speed reduction ratio; and at the same time, the respective internal sun gears are formed in a single cylindrical body. Thus, the speed reduction mechanism itself can be made compact.

Furthermore, the motor shaft gear coupled to the output shaft of the motor is used as the external sun gear of the first-stage planetary gear assembly (among the planetary gear assembles provided in multiple stages); accordingly, the center of rotation of the output shaft of the motor and the center of rotation of the speed reduction mechanism are aligned to be on the same straight line or axis. As a result, it is possible to design the overall outer diameter of the speed reduction mechanism and motor to be small, so that the electric shaver can be made much more compact.

BRIEF DESCRIPTION OF THE DRAWINGS

FIG. 2 being a view taken along the line 2—2 in FIG. 3;

DETAILED DESCRIPTION OF THE PREFERRED EMBODIMENTS

One preferred embodiment of the electric shaver of the present invention will be described in detail with reference to the accompanying drawings.

Figure 1:
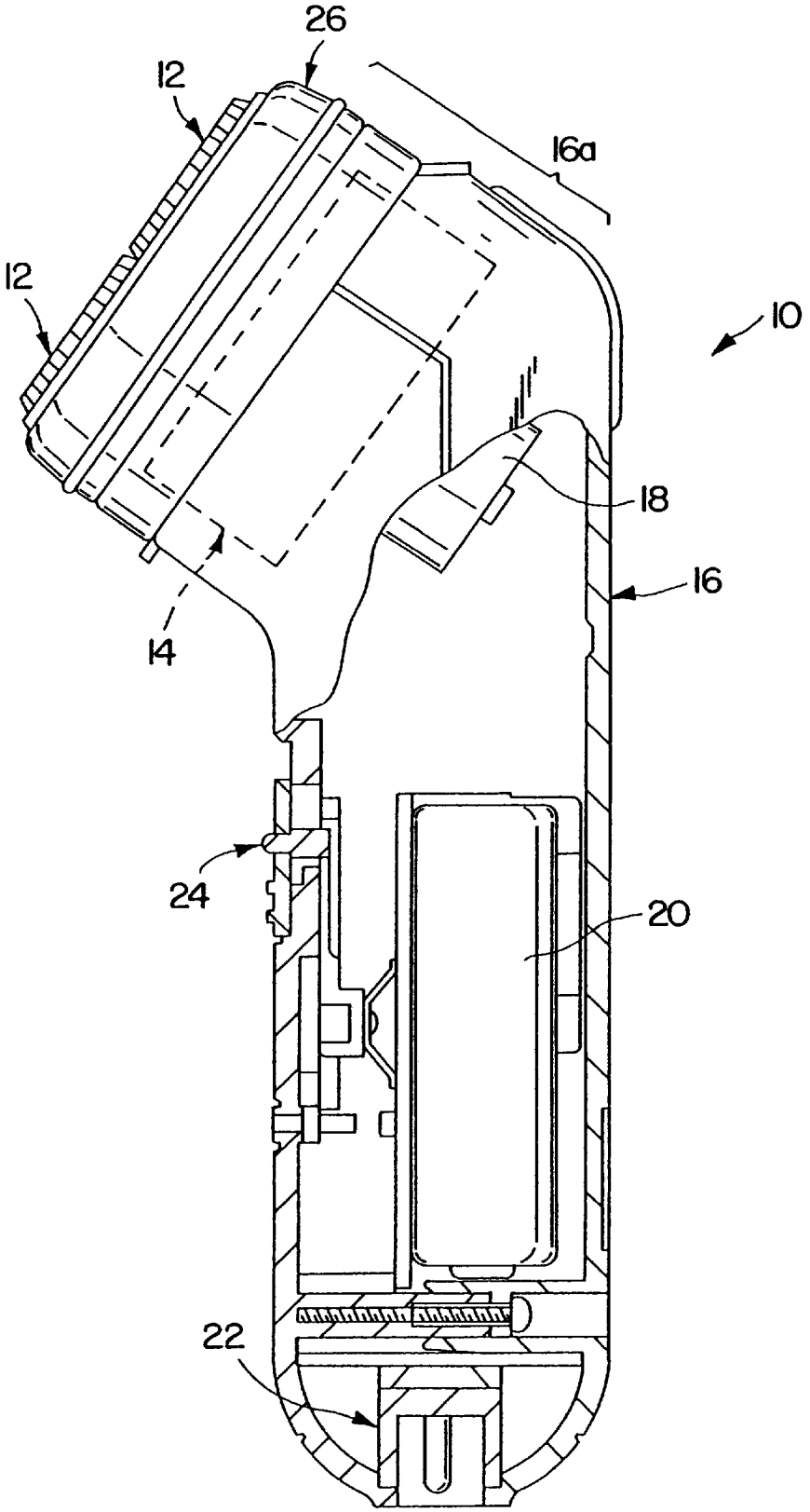
FIG. 1 is a partially cut-away side view of one embodiment of the electric shaver of the present invention.
Figure 3:
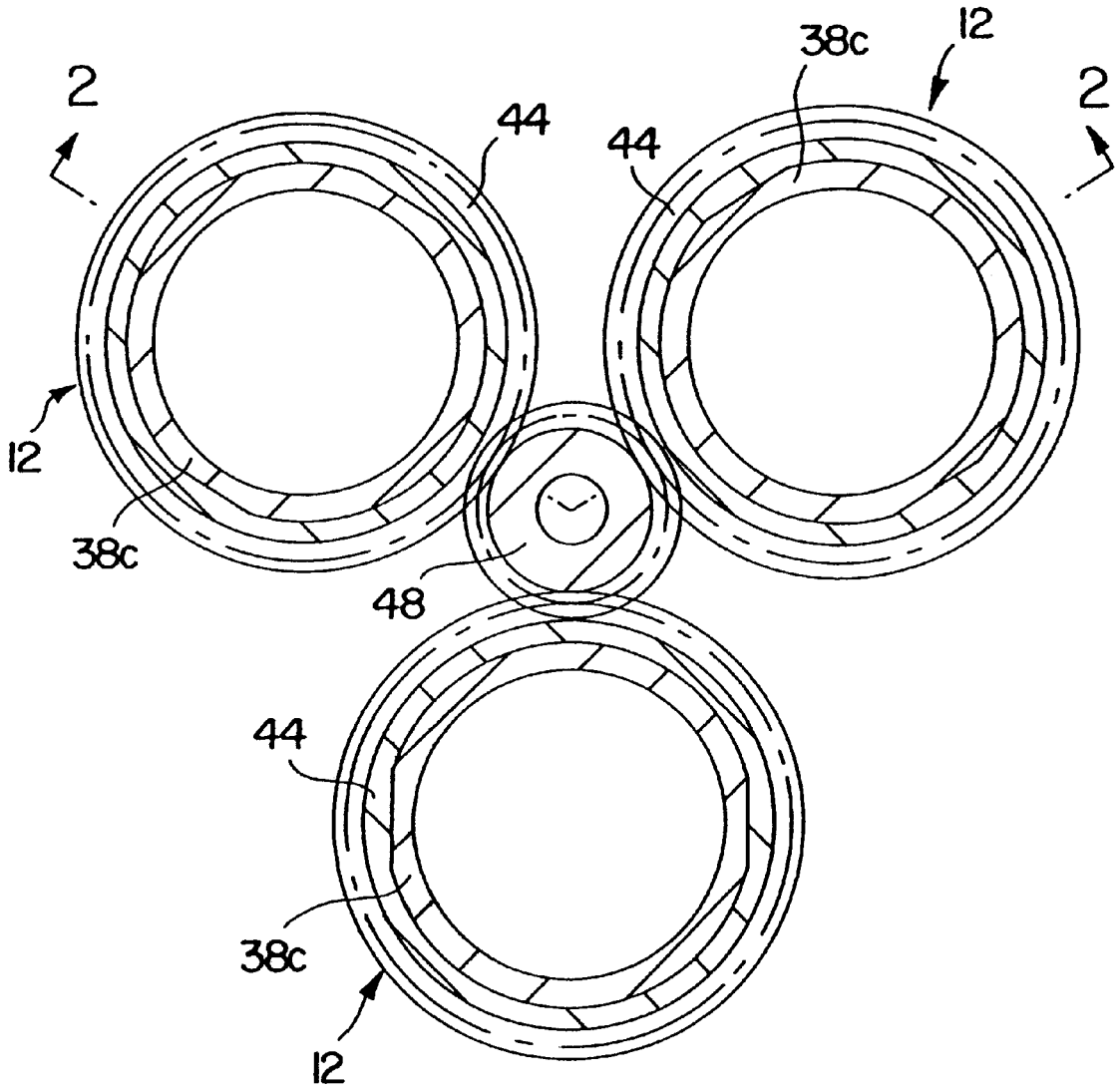
FIG. 3 is a schematic illustration showing the relation between the speed reduction output gear and annular gears for the outer cutters viewed in the direction of the line 3—3 in FIG. 2.

The shaver 10 shown in FIG. 1 includes three outer and inner cutters (or three pairs of outer and inner cutters)

arranged in an inverse equilateral triangle shape as best seen from FIG. 3. The present invention is, however, applicable to shavers that include one set or two sets of outer and inner cutters.

The electric shaver 10 in this embodiment generally comprises a synthetic resin housing 16, an electric motor 18, a battery unit 20, a connector 22 and a switch 24.

The housing 16 has a head part 16*a* at an upper portion thereof so that outer cutter units 12 are installed therein in a partially exposed fashion, and inside the head part 16*a* is provided a driving mechanism 14 for activating the outer cutter units 12. The electric motor 18 is installed in the lower portion of the head part 16*a* inside the housing 16 so as to operate the driving mechanism 14. The battery unit 20 is installed inside the lower area of the housing 16, and it supplies electric power to the electric motor 18. The connector 22 is installed in the lower end of the housing 16 so as to supply a charging current to the battery 20 from the outside of the shaver. The slide type (or any other type) switch 24 is mounted on the outer surface (or front side) of the housing 16 so as to be used to switch ON and OFF the electric current supply from the battery 20 to the electric motor 18.

The construction of the inside of the head part 16*a* is described in detail with reference to FIG. 2.

The upper end of the head part 16*a* of the housing 16 is open and is covered by a detachable head frame 26; and a mounting plate 28 and a drive shaft holder 30 are installed inside the head part 16*a*.

The head frame 26 has a cutter attachment frame 34 which is fitted in a detachable manner to the head frame 26 by an attachment screw 32 so as to be disposed inside the head frame 26. Thus, the cutter attachment frame 34 holds the outer cutter units 12 between this cutter attachment frame 34 and the head frame 26 so that the outer cutter units 12 can be rotated.

Each outer cutter unit 12 is constructed from an outer cutter 36 and an outer cutter holder 38 and includes an inner cutter 40 installed therein.

Furthermore, the head frame 26 is formed with circular first openings 42 which match the shape of the outer cutters 36 in a number equal to the number of outer cutters 36 (three (3) in this embodiment), and the upper surfaces of the outer cutters 36 of the outer cutter units 12 held as described above protrude to the outside from the outer surface of the head frame 26 as best seen in FIG. 1.

The construction of the outer cutter units 12 will be described below in detail. Three outer cutter units 12 are employed in this embodiment, and they have the same structures; and each comprises the outer cutter 36 and the outer cutter holder 38 with an inner cutter 40.

Each outer cutter 36 has a flange 36*a* formed on the lower circumferential portion thereof.

Each outer cutter holder 38 is in a tubular shape and has a larger-diameter portion 38*a* formed at upper end (in FIG. 2) thereof and a smaller-diameter portion 38*c* formed at lower end (in FIG. 2) thereof.

The lower portion of the corresponding outer cutter 36 is inserted into the larger-diameter portion 38*a* of the outer cutter holder 38. A hook portion 38*b* is formed by inwardly constricting the edge portion of the larger-diameter portion 38*a* and engages with the flange 36*a* of the outer cutter 36 so that the outer cutter 36 and outer cutter holder 38 are integrally connected. Furthermore, an annular gear 44 which engages with the speed reduction output gear of the speed reduction mechanism (described later) is attached to the outer circumference of the smaller-diameter portion 38*c* of the outer cutter holder 38. The annular gear 44 is formed from, for instance, a synthetic resin material and is securely fitted on the outer circumference of the smaller-diameter portion 38*c* of the outer cutter holder 38. Alternatively, the annular gear 44 may be formed integrally on the outer circumferential surface of the smaller-diameter portion 38*c* of the outer cutter holder 38.

Furthermore, the respective outer cutter units 12 are held between the head frame 26 and the cutter attachment frame 34 in such a manner that the outer cutter units 12 can be rotated. This rotatable arrangement is obtained by inserting the upper portions of the outer cutters 36 (which have hair entry slits (not shown) formed in the upper surfaces and side surfaces) into the first openings 42 formed in the head frame 26 and by inserting the smaller-diameter portions 38*c* on which the annular gears 44 are installed into second openings 46 formed in the cutter attachment frame 34. The second openings 46 are formed so that they are equal in number to the first openings 42 and positionally correspond to the first openings 42. The internal diameter of the second openings 46 is smaller than the external diameter of the large-diameter portions 38*a* of the outer cutter holders 38, so that the respective outer cutter units 12 are prevented from slipping out of the cutter attachment frame 34.

Furthermore, as shown in FIG. 3, a speed reduction output gear 48 which is an output gear of the speed reduction mechanism (described below) is installed at the center which is defined by three annular gears 44 of the triangularly-arranged outer cutter units 12 so that the speed reduction output gear 48 engages with the respective annular gears 44.

The driving mechanism 14 will be described below with reference to FIG. 2.

Figure 2:
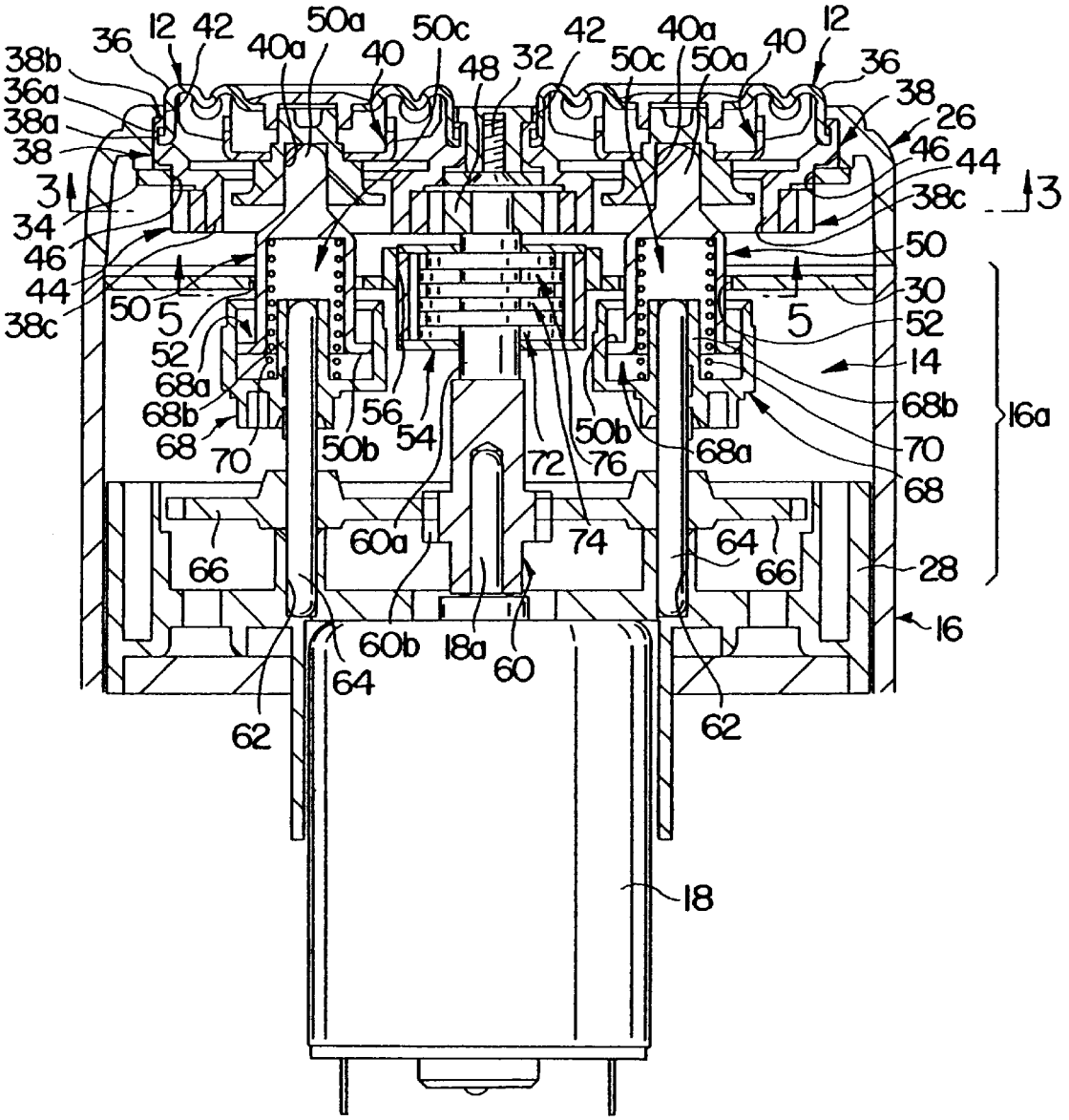
FIG. 2 illustrates the internal construction of the head section and head frame of the shaver of FIG. 1.

The drive shaft holder 30 is formed with three (3) shaft insertion holes 52 so as to correspond to the three outer cutter units 12, and three (3) drive shafts 50 (only two (2) shown in FIG. 2) for rotating the inner cutters 40 are rotatably inserted into the shaft insertion holes 52. These insertion holes 52 are arranged in an inverse triangle shape, and a mounting hole 56 is formed in the central area thereof surrounded by these three (3) shaft insertion holes 52 so that a speed reduction mechanism 54 which is a cylindrical shape is inserted into the mounting hole 56.

The drive shafts 50 are respectively provided with engaging tongues 50*a*. Each of the engaging tongue parts 50*a* is formed at one end (upper end in FIG. 2) of each drive shaft 50 so as to be located closer to the outer cutter units 12. The tongue of the drive shafts 50 are inserted into engaging holes 40*a* formed in the inner cutters 40 so that the rotational force of the drive shafts 50 can be transmitted to the inner cutters 40. The drive shafts 50 are further provided with flanges 50*b*. Each of the flanges 50*b* is formed at another end (lower end in FIG. 2) of each drive shaft 50 and located closer to the mounting plate 28. The flanges 50*b* of the drive shafts 50 are inserted into hollow hubs 68 (described later).

The electric motor 18 is mounted to the undersurface of the mounting plate 28 so that the output shaft 18*a* of the motor 18 enters the area between the mounting plate 28 and the drive shaft holder 30, and a motor shaft gear 60 is coupled to the output shaft 18*a* of the motor 18. The motor shaft gear 60 is formed at the tip end thereof (or top end thereof in FIG. 2) with an end gear section 60*a* that is used as an external sun gear of the first-stage planetary gear assembly 72 of the speed reduction mechanism 54; and in addition, the motor shaft gear 60 is formed at a vertically intermediate portion thereof (in FIG. 2) with a base gear section 60*b* that is formed circumferentially on the motor shaft gear 60 and engages with inner cutter drive gears 66 attached to three transmission shafts 64 (described later).

Furthermore, three shaft supporting holes 62 are formed in the mounting plate 28 so as to face the drive shaft holder 30. These three shaft support holes 62 (only two shown) are concentric with the three shaft insertion holes 52 which are opened in the drive shaft holder 30; and respective transmission shafts 64 are inserted into these shaft supporting holes 62 so that the transmission shafts 64 are parallel to the output shaft 18*a* of the motor 18 and rotatable about their own axes in the shaft supporting holes 62.

Each transmission shaft 64 has the inner cutter drive gear 66 which circumferentially engages with the base gear section 60*b* of the motor shaft gear 60; and a hollow hub 68, which has a cylindrical cavity area 68*a* that opens toward the drive shaft holder 30, is attached to the tip end (or to the upper end in FIG. 2) of each transmission shaft 64.

The tip ends (lower ends in FIG. 2) of the respective drive shafts 50 on which the flanges 50*b* are formed are inserted into the cavity areas 68*a* of the hollow hubs 68, and the drive shafts 50 are thus connected to the hollow hubs 68. Ribs (not shown) which run along the direction of the transmission shafts 64 (or in a vertical direction in FIG. 2) are formed on the inside wall surfaces of the hollow hubs 68, and cut-outs (not shown) are formed in the flanges 50*b*, so that the respective drive shafts 50 are inserted into the cavity areas 68*a* of the hollow hubs 68, and the ribs and cut-outs are engaged. Thus, each drive shaft 50 can be moved in the direction of the axis of the transmission shaft 64 relative to the corresponding hollow hub 68; and when the hollow hubs 68 are rotated by the motor 18 via the inner cutter drive gears 66, the drive shafts 50 are rotated by the hollow hubs 68.

A coil spring 70 is installed inside each cavity area 68*a* of the hollow hubs 68 so that the corresponding drive shaft 50 is constantly urged toward the outer cutter unit 12 relative to the hollow hub 68.

In other words, in the above embodiment, a tubular portion 68*b* is formed in the center of the inside of the cavity area 68*a* of each hollow hub 68, and the tip (lower) end of the corresponding transmission shaft 64 is inserted into the tubular portion 68*b*; and in addition, a second cavity area 50*c* which opens towards the hollow hub 68 is formed in the drive shaft 50 so that the tubular portion 68*b* is inserted into this second cavity area 50*c*. In addition, the coil spring 70 is fitted loosely over the tubular porion 68*b* of the hollow hub 68 and disposed inside the second cavity area 50*c*.

Next, the speed reduction mechanism 54 will be described with reference to FIGS. 4 and 5.

In the electric shaver 10 of the present invention, the inner cutters 40 are rotated (at a high speed), and the outer cutters 36 are rotated as well so that hairs are positively brought into the hair entry slits opened in the outer cutters 36.

In addition, in order to allow sufficient rotary driving of the outer cutters without causing abrasion injuries to the skin, which are caused by the high-speed rotation of the outer cutters, and without using a high-torque electric motor, a speed reduction mechanism 54 is installed in the present invention between the electric motor 18 and annular gears 44 provided on the outer cutters 36. In addition, the speed reduction mechanism 54 is constructed from planetary gear assemblies in order to minimize the size of the speed reduction mechanism 54 itself while obtaining a large speed reduction ratio.

Figure 4:
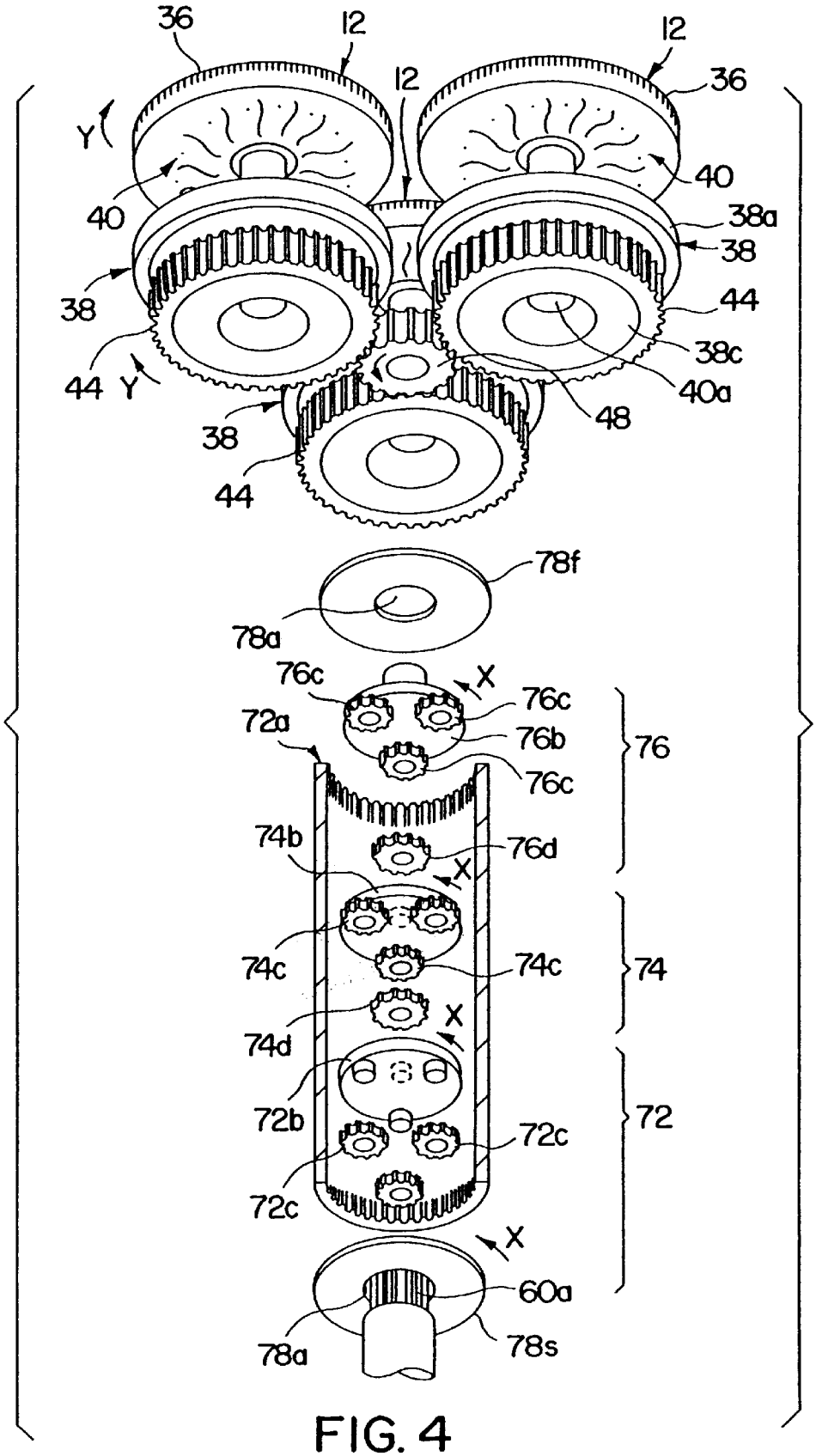
FIG. 4 is an exploded illustration of the internal construction of the speed reduction mechanism employed in the present invention.
Figure 5:
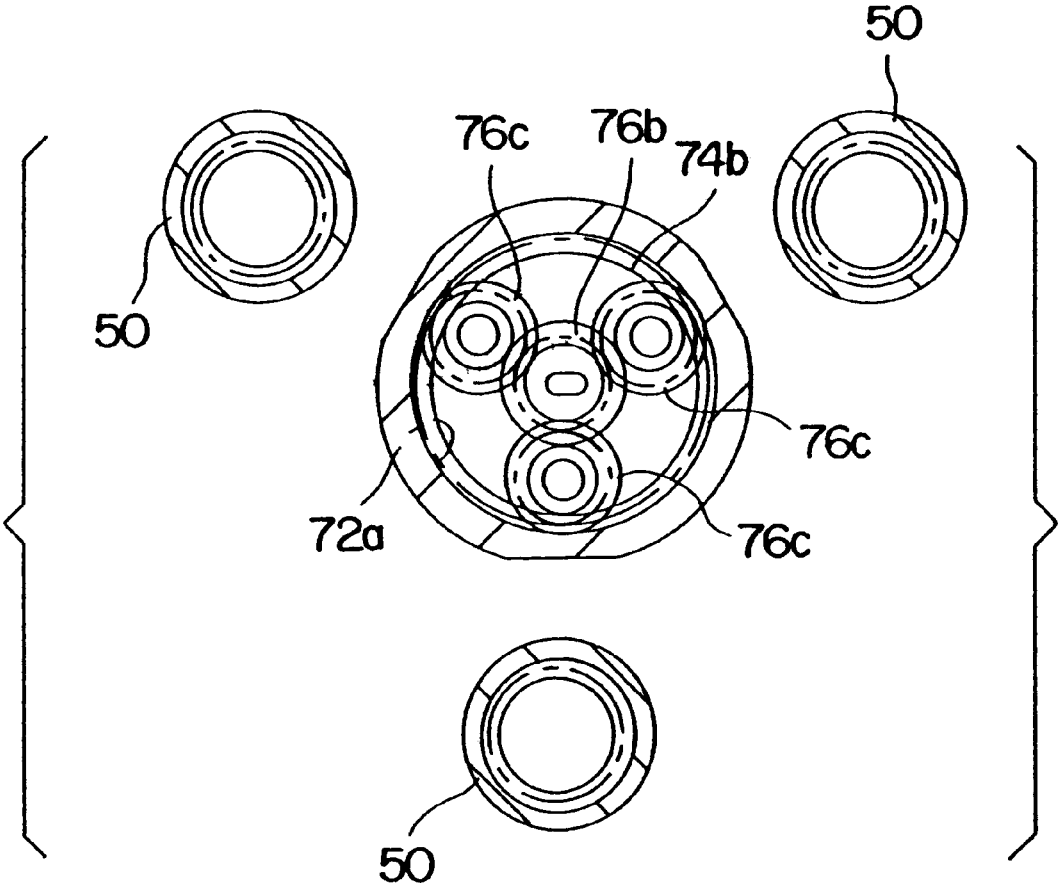
FIG. 5 is a schematic illustration showing the relation between the speed reduction mechanism and inner cutter drive shafts viewed in the direction of the line 5—5 in FIG. 2.

More specifically, as shown in FIG. 2 and in detail in FIG. 4, the speed reduction mechanism 54 is constructed from a plurality (three in this embodiment) of planetary gear assemblies 72, 74 and 76 which are installed in parallel one on the other, or in a stacked fashion, adjacent to each other in multiple stages in a vertical direction in FIGS. 2 and 4.

Each of these planetary gear assemblies 72, 74 and 76 will be described below in this order.

A first-stage planetary gear assembly 72 is positioned closest to the electric motor 18, and it consists of a cylindrical internal sun gear 72*a*, a plurality of (or three) planet gears 72*c* which are rotatably provided on the undersurface of a first carrier disk 72*b* and engage with the internal sun gear 72*a*, and an external sun gear which is the end gear section 60*a* (of the motor shaft gear 60) and disposed in the center so as to be surrounded by the plurality of planet gears 72*c* and further engages with the respective planet gears 72*c*.

In the present embodiment, the internal sun gear 72*a* has an axial length which corresponds to the combined thicknesses of the three stacked-fashioned planetary gear assemblies 72, 74 and 76, so that the internal sun gear 72*a* acts as an internal sun gear for all of the planetary gear assemblies 72, 74 and 76.

The second planetary gear assembly 74 consists of the internal sun gear 72*a* described above, a plurality of (three) planet gears 74*c* which are rotatably provided on the undersurface of a second carrier disk 74*b*, and an external sun gear 74*d* which is disposed in the central area surrounded by the plurality of planet gears 74*c* and engages with the respective planet gears 74*c*. The external sun gear 74*d* is fastened to the upper surface of the first carrier disk 72*b* at the center of rotation.

The third planetary gear assembly 76 consists of the internal sun gear 72*a* described above, a plurality of (three) planet gears 76*c* which are rotatably provided on the undersurface of a third carrier disk 76*b*, and an external sun gear 76*d* which is disposed in the central area surrounded by the plurality of planet gears 76*c* and engages with the respective planet gears 76*c*. The external sun gear 76*d* is fastened to the upper surface of the second carrier 74*b* so as to be at the center of rotation thereof In other words, the constituting elements of the respective planetary gear assemblies 72, 74 and 76 are disposed inside the internal sun gear 72*a* which is a single continuous cylindrical body used commonly to the three planetary gear assemblies 72, 74 and 76; and these planetary gear assemblies 72, 74 and 76 are arranged so that the external sun gear (74*d*, 76*d*) of each planetary gear assembly is provided on the carrier disk (72*b*, 74*b*) of a preceding (lower) planetary gear assembly so as to be positioned at the center of rotation of the carrier disks.

As seen from the above, in the present invention, a single internal sun gear 72*a* is used commonly with the respective planetary gear assemblies 72, 74 and 76 thus being as an integral body that has the same external diameter, and the plurality of planetary gear assemblies 72, 74 and 76 are provided one on the other in multiple stages (or arranged vertically in FIG. 4). Accordingly, the volume of the speed reduction mechanism 54 itself is more compact than in cases where the speed reduction mechanism is constructed by arranging a plurality of spur gears substantially horizontally. Thus, the electric shaver 10 itself can be made more compact. Also, in a prefered construction, the gears 76*c*, 74*c* and 72*c*, the gears 74*d* and 76*d* and the disks 72*b* and 74*b* would be the same size to recude costs.

The constituting elements of the three planetary gear assemblies 72, 74, 76 described above are prevented from slipping out of the tubular internal sun gear 72*a* by first and second lids 78*f* and 78*s* which are attached to both openings (upper and lower ends in FIG. 4) of the internal sun gear 72*a*.

The thus obtained speed reduction mechanism 54 is fastened to the drive shaft holder 30 by inserting the internal sun gear 72*a* into the mounting hole 56 of the holder 30.

Furthermore, the speed reduction output gear 48 described above is attached, as an output gear of the speed reduction mechanism 54, to the upper surface of the third carrier disk 76*b* of the uppermost stage planetary gear assembly 76 so as to be at the position of the center of rotation. The speed reduction output gear 48 protrudes from a central hole 78*a* of the first lid 78*f* and is positioned at the center surrounded by the three annular gears 44 attached to the respective outer cutter units 12, so that the speed reduction output gear 48 meshes with the respective annular gears 44.

Likewise, the motor output shaft 60 that has the end gear section 60*a* (used as the external sun gear for the first-stage gear assembly 72) is inserted into a central hole 78*a* of the second lid 78*s* of the internal sun gear 72*a*.

With the arrangement above, the respective transmission shafts 64, drive shafts 50 and outer cutter units 12 are, as best seen from FIG. 2, disposed on the same rotational axes which are parallel to the output shaft 18*a* of the electric motor 18. On the other hand, the center of the speed reduction mechanism 54 obtained by arranging three planetary gear assemblies 72, 74 and 76 one on the other in multiple stages is positioned on the same rotational axis as the output shaft 18*a* of the electric motor 18.

The operation of the embodiment described above will now be described.

First, when the slide switch 24 is operated, electric current is supplied to the electric motor 18 from the battery 20, and the electric motor 18 is actuated so as to rotate the output shaft 18*a*, thus rotating the motor shaft gear 60 coupled to the output shaft 18*a*. As a result, the outer cutter units 12 and inner cutters 40 are rotationally driven.

The rotational drive of the outer cutter units 12 and the inner cutters 40 will be respectively described below.

First, the rotation of the inner cutters 40 will be described.

When the motor shaft gear 60 is rotated (the direction of the rotation of gear 60 is referred to as X), the three inner cutter drive gears 66 which engage with the base gear section 60*b* of the motor shaft gear 60 respectively rotate in the direction Y, which is opposite from the rotational direction X of the motor shaft gear 60, so that the three hollow hubs 68 attached to the tip ends of the respective transmission shafts 64 also rotate in the same direction Y. Accordingly, the three drive shafts 50 connected to the hollow hubs 68 also rotate in the same direction Y, so that the inner cutters 40 disposed inside the respective outer cutter units 12 rotate in the direction Y which is opposite from the rotational direction X of the motor shaft gear 60.

In this case, where Z2 is the number of teeth on the base gear section 60*b* and Z3 is the number of teeth on the inner cutter drive gears 66, the speed reduction ratio between them is Z3/Z2. If, for example, Z2=16 and Z3=36, the speed reduction ratio Ri (between the inner cutter drive gears 66 and the base gear section 60*b*)=36/16=2.25.

Next, the rotation of the outer cutters 36 will be described.

When the motor shaft gear 60 is rotated in the direction X as described above, the rotational force is transmitted to the speed reduction mechanism 54 from the end gear section 60*a* of the motor shaft gear 60.

The transmission of the rotational force of the speed reduction mechanism 54 is accomplished as follows:

(1) First, the planet gears 72*c* of the first planetary gear assembly 72 which are engaged with the end gear section 60*a* make a circular motion along the inside circumference of the internal sun gear 72*a* in the direction X which is the same as the end gear section 60*a* (while the planet gears 72*c* themselves rotate). As a result, the carrier 72*b* rotates (revolves) in the direction X about the end gear section 60*a*.

(2) In the second planetary gear assembly 74, as in the first planetary gear assembly 72, the external sun gear 74*d* attached to the carrier 72*b* is rotated in the same direction X as the end gear section 60*a*; and therefore, the planet gears 74*c* rotate around their own axes and also revolve about the end gear section 60*a*, and the carrier 74*b* is also rotated in the same direction X.

(3) Furthermore, in the third planetary gear assembly 76, as in the first planetary gear assembly, the external sun gear 76*d* attached to the second carrier 74*b* is rotated in the same direction X as the end gear section 60*a*; accordingly, the planet gears 76*c* are rotated around their own axes and also revolve about the end gear section 60*a*, and the third carrier 76*b* is also rotated in the same direction X.

The speed reduction ratio of this speed reduction mechanism 54 can be expressed as follows:

Where Zo is the number of teeth of the internal sun gear 72*a*, Zu1 is the number of teeth on the end gear section 60*a* (constituting the external sun gear of the first planetary gear assembly), Zu2 is the number of teeth on the second external sun gear 74*d*, and Zu3 is the number of teeth on the third external sun gear 76*d*, then the speed reduction ratio $Rg=(1+Zo/Zu1)\times(1+Zo/Zu2)\times(1+Zo/Zu3)$ In the present embodiment, for example, Zo=36, and Zu1=Zu2=Zu3=12; accordingly, the speed reduction ratio Rg=4×4×4=64.

As a result of the rotation of the third (or upper-most) carrier 76*b* of the speed reduction mechanism 54 in the direction X as described above, the speed reduction output shaft 48 attached to the third carrier 76*b* is rotated in the direction X, and this rotational force is transmitted to annular gears 44 of the outer cutter units 12 so as to rotate the annular gears 44 in the direction Y. As a result, the outer cutter units 12 are rotated in the direction Y which is opposite from the end gear section 60*a* rotated in the direction X. Accordingly, the outer cutters 36 themselves are rotated together with the outer cutter units 12 in the direction Y.

In this case, the entire speed reduction ratio Ro of the outer cutter units 12 with reference to the electric motor 18 can be expressed as:

$$Ro=Rg\times Z5/Z4$$

where Z4 is the number of teeth on the speed reduction output gear 48, and Z5 is the number of teeth on the annular gears 44.

In the embodiment above, for example, Z4=16 and Z5=45; therefore, the speed reduction ratio Ro=64×45/16=180.

As seen from the above, since the outer cutters 36 are rotated, hairs such as whiskers, etc. can be positively introduced into the slits (not shown) formed in the outer cutters 36 even if the electric shaver 10 is not constantly moved around on the skin while being held with one hand. Accordingly, efficient shearing is accomplished, and fatigue of the arm muscles is alleviated.

Furthermore, the inner cutters 40 and outer cutters 36 are rotated in the same direction Y; however, the speed reduction ratio of the inner cutters 40 (relative to the motor 18) is approximately 2 (2.25), so that the inner cutters 40 rotate at a high speed; on the other hand, the speed reduction ratio of the outer cutters 36 (relative to the motor 18) is 180, so that the outer cutters 36 rotate at an extremely low speed. Accordingly, as a result of the difference in the relative rotational speeds of the outer cutters 36 and inner cutters 40, hairs introduced via the slits in the outer cutters 36 are cut by shearing force. Furthermore, since the outer cutters 36 are rotated very slowly, the skin which directly contacts the outer cutters 36 is not injured by friction generated between the skin and the outer cutters 36. Moreover, since the speed reduction ratio is large, the outer cutters 36 can rotate at a prescribed rotational speed against the contact resistance of the skin even if a high-torque electric motor is not used.

Furthermore, the outer cutters 36 and inner cutters 40 are rotationally driven by means of a single electric motor 18; accordingly, the rotational speed ratio can remain constant (for instance, 2.25 to 180 in the embodiment described above) even if the rotational speed of the electric motor 18 fluctuates due to variations in the voltage of the battery 20. Thus, when the outer cutters 36 are rotated at an appropriate rotational speed below 100 rpm (preferably 40 to 60 rpm), then the inner cutters 40 are rotated at approximately 3,900 rpm. Furthermore, since the single electric motor 18 is used as the driving source for the outer and inner cutters 36 and 40, the shaver can be made compact.

Various aspects of a preferred embodiment of the present invention is described above. However, the present invention is not limited to the above embodiment.

In the embodiment above, three planetary gear assemblies are employed. However, the number of planetary gear assemblies can be modified in accordance with the desired speed reduction ratio of the speed reduction mechanism 54. For instance, in cases where a smaller speed reduction ratio is sought, the number of planetary gear assemblies can be reduced to two (and not three), while when a larger speed reduction ratio is preferred, the number of planetary gear assemblies can be increased to four or more.

Furthermore a speed reduction mechanism formed by a plurality of planetary gear assemblies arranged in multiple stages can also be used in cases where the number of outer cutter units is one or two units.

In addition, the diameters and numbers of teeth of the gears and the number of planetary gear assemblies used can be varied in accordance with the specifications of the demanded electric shaver, and the embodiment described above is merely an example of the present invention.

Moreover, in the above embodiment, the inner cutters 40 and outer cutters 36 are rotated in the same direction; however, it is possible to design it so that these cutters are rotated in opposite directions. This is accomplished by inserting inverting gears between the base gear section 60*b* and the inner cutter drive gears 66.

The present invention is not limited to the described embodiments, and it goes without saying that various modifications are possible within the spirit of the present invention.

As seen from the detailed description above, according to the present invention, planetary gear assemblies are employed so as to reduce the rotational speed of the outer cutters. Accordingly, such a speed reduction mechanism can be made more compact than speed reduction mechanisms that use spur gears, and in addition a larger speed reduction ratio can be obtained.

Furthermore, according to the present invention, a larger speed reduction ratio is obtained by arranging a plurality of planetary gear assemblies in multiple stages, and internal planetary gears of this planetary gear assembly are formed in a single continuous cylindrical body; accordingly, the other constituting elements of the respective planetary gear assemblies such as planet gears, external sun gears and carriers, etc. can be accommodated inside the cylindrical internal sun gear element, thus making it possible to reduce the size of the speed reduction mechanism itself even further. In addition, since the motor shaft gear coupled to the motor output shaft is used as the external sun gear of the first planetary gear assembly among the planetary gear assemblies provided in multiple stages inside the cylindrical internal sun gear, the center of rotation of the output shaft of the motor and the center of rotation of the speed reduction mechanism are on the same straight line. Accordingly, the overall outer diameter of the speed reduction mechanism and motor can be reduced, so that the electric shaver can be made even more compact.

I claim:

1. An electric shaver equipped with a single electric motor, outer cutters which are rotationally driven by said electric motor, and inner cuters which are installed in combination with said outer cutters and rotationally driven by said electric motor, said shaver being provided with a speed reduction mechanism constructed from a planetary gear assembly installed between a motor shaft gear attached to an output shaft of said electric motor and gears installed on said outer cutters and wherein said speed reduction mechanism comprises:

a plurality of planetary gear assemblies, each consisting of an internal sun gear, a plurality of plant gears which are rotatably provided on a carrier and engage with said internal sun gear, and an external sun gear which is disposed in a center of said plurality of planet gears so as to engage wit each of said planet gears, and wherein said plurality of planetary gear assemblies are provided in multiple stages, said internal sun gear is formed in a single continuous cylindrical body so as to be commonly used wit said planet gears, and one of said planetary gear assemblies is meshed with said external sun gear of another adjacent planetary gear assembly at a position of center of rotation of said carrier of said adjacent planetary gear assembly.

2. An electric shaver according to claim 1, wherein said motor shaft gear is an external sun gear of a first planetary gear assembly among said planetary gear assemblies provided in multiple stages.

3. An electric shaver comprising a single electric motor, a plurality of rotatable circular outer cutters, a plurality of inner cutters rotatably installed inside said outer cutters, and a speed reduction mechanism coupled to said plurality of outer cutters, wherein an output shaft of said single electric motor is coaxially linked to said speed reduction mechanism which has a speed reduction output gear meshing with gears provided on peripheries of said plurality of outer cutters so that said plurality of outer cutters are rotated by said single electric motor, and said output shaft of said single electric motor being circumferentially linked to gear chains each coupled to each of said plurality of inner cutters so that said plurality of inner cutters are rotated by said single electric motor.

4. An electric shaver according to claim 3, wherein said speed reduction mechanism comprises:

an internal sun gear of a cylindrical shape, and a plurality of carrier disks installed in said internal sun gear so as to be positioned parallel and one on the other, each of said plurality of carrier disks being provided with a plurality of rotatable planet gears which engage with said internal sun gear, and said plurality of carrier disks being linked together by external sun gears each engaging with said planet gears provided on each of said plurality of carrier disks, and wherein said output shaft of said motor is coupled via a motor shaft gear attached thereto to one of said plurality of carrier disks positioned at one end of said internal sun gear, and said speed reduction output gear of said speed reduction mechanism is connected to another of said plurality of carrier disks positioned at the other end of said internal sun gear.

* * * * *